US010051802B2

(12) United States Patent
Paulitz et al.

(10) Patent No.: US 10,051,802 B2
(45) Date of Patent: Aug. 21, 2018

(54) APPARATUS AND METHOD FOR ISOLATING BAST BARK AND WOOD BODY FROM A BAST PLANT STEM

(71) Applicant: BAST & FASER GMBH, Adelsdorf (DE)

(72) Inventors: Jürgen Paulitz, Dresden (DE); Robert Hertel, Herzogenaurach (DE); Rainer Nowotny, Prenzlau (DE)

(73) Assignee: BAST & FASER GMBH, Adelsdorf (DE)

( * ) Notice: Subject to any disclaimer, the term of this patent is extended or adjusted under 35 U.S.C. 154(b) by 127 days.

(21) Appl. No.: 14/912,022

(22) PCT Filed: Aug. 14, 2014

(86) PCT No.: PCT/EP2014/002237

§ 371 (c)(1),
(2) Date: May 31, 2016

(87) PCT Pub. No.: WO2015/022078

PCT Pub. Date: Feb. 19, 2015

(65) Prior Publication Data

US 2016/0270315 A1 Sep. 22, 2016

(30) Foreign Application Priority Data

Aug. 16, 2013 (DE) ..... 10 2013 013 657

(51) Int. Cl.
*D01B 1/30* (2006.01)
*D01B 1/16* (2006.01)
(Continued)

(52) U.S. Cl.
CPC ..... *A01H 5/04* (2013.01); *D01B 1/16* (2013.01); *D01B 1/30* (2013.01); *D01B 9/00* (2013.01)

(58) Field of Classification Search
CPC ... D01B 1/30; D01B 1/10; D01B 9/00; D01B 1/16; A01H 5/04; A23N 11/00; B27J 7/00; B27L 11/08; D21B 1/30
See application file for complete search history.

(56) References Cited

U.S. PATENT DOCUMENTS 2,980 A * 3/1843 Johnson ..... D01B 1/14 19/33
1,601,984 A * 10/1926 Selvig ..... D01B 1/22 19/12

(Continued)

FOREIGN PATENT DOCUMENTS

DE 12785 C 4/1881
DE 388277 C 1/1924

(Continued)

OTHER PUBLICATIONS

Machine Translation of DE-682925 published on (Year: 1941).*

(Continued)

*Primary Examiner* — Jose A Fortuna
(74) *Attorney, Agent, or Firm* — Merchant & Gould P.C.

(57) ABSTRACT

A method for isolating bast bark and wood bodies from a bast plant stem (18), whereby the bast plant stem (18) is formed internally by an essentially cylindrical wood body (9), and the wood body (9) is radially covered by a bast bark (3*c*) containing bast fibers, and is connected to the bast bark (3*c*) via a meristem tissue (11), which intends that the bast bark (3*c*) is separated by means of a tensile force (Fz) from the wood body (9), or at least from a constituent part of the wood body (9) through the division of the meristem tissue (11).

10 Claims, 5 Drawing Sheets

(51) Int. Cl.

| | |
|---|---|
| ***D01B 9/00*** | (2006.01) |
| ***D21B 1/30*** | (2006.01) |
| ***A01H 5/04*** | (2018.01) |

(56) References Cited

U.S. PATENT DOCUMENTS

| | | | | | |
|---|---|---|---|---|---|
| 2,244,971 | A * | 6/1941 | St John | D01B 1/22 | 19/21 |
| 2,706,312 | A * | 4/1955 | Bobkowicz | D01B 1/14 | 19/10 |
| 2,747,232 | A * | 5/1956 | Armstrong | D01B 1/10 | 19/115 R |
| 4,636,263 | A * | 1/1987 | Cundiff | C13B 10/00 | 127/42 |
| 6,079,647 | A * | 6/2000 | Leduc | D01B 1/16 | 19/24 |
| 9,080,257 | B2 * | 7/2015 | Lupien | D01B 1/30 | |
| 2008/0020449 | A1 * | 1/2008 | Matsubara | D01C 1/02 | 435/263 |
| 2008/0090078 | A1 * | 4/2008 | Liu | D01B 1/10 | 428/401 |
| 2009/0145563 | A1 * | 6/2009 | Jarck | B27J 7/00 | 162/28 |
| 2011/0099766 | A1 * | 5/2011 | Bubnov | D01B 1/10 | 19/7 |
| 2012/0324677 | A1 * | 12/2012 | Hao | D01C 1/02 | 19/5 A |
| 2013/0167327 | A1 * | 7/2013 | Lupien | D01B 1/28 | 19/9 |
| 2016/0083866 | A1 * | 3/2016 | Dyas | D01B 1/28 | 19/9 |
| 2016/0270315 | A1 * | 9/2016 | Paulitz | D01B 1/30 | |

FOREIGN PATENT DOCUMENTS

| | | | | | |
|---|---|---|---|---|---|
| DE | 685925 | C | | 9/1941 | |
| DE | 754085 | C | | 12/1952 | |
| DE | 864731 | C | | 1/1953 | |
| DE | 19518188 | A1 | | 11/1996 | |
| DE | 19626557 | A1 | | 1/1998 | |
| DE | 19918166 | A1 | | 10/2000 | |
| DE | 10007509 | A1 | | 8/2001 | |
| DE | 10162361 | A1 | | 5/2002 | |
| EP | 941649 | A2 | * | 9/1999 | A01D 45/06 |
| EP | 1155172 | B1 | | 9/2005 | |
| GB | 190612433 | A | * | 3/1907 | D01H 5/22 |
| GB | 105094 | A | * | 3/1917 | D01B 1/22 |
| GB | 342672 | A | | 1/1931 | |
| GB | 691751 | A | * | 5/1953 | D01B 1/20 |
| GB | 739611 | A | * | 11/1955 | D01B 1/22 |
| WO | 97/45573 | A1 | | 12/1997 | |
| WO | WO-2011088750 | A1 | * | 7/2011 | D01C 1/02 |
| WO | 2012/006118 | A2 | | 1/2012 | |
| WO | WO-2012006118 | A2 | * | 1/2012 | D01B 1/28 |

OTHER PUBLICATIONS

Gustav Schaefer: "Flax and Hemp", CIBA-Rundschau. Nr. 62, Gesellschaft chem. Industrie Basel, 1944, pp. 2262-2294 , with English Abstract (7 pages).

International Search Report for PCT/EP2014/002237, dated Nov. 19, 2014.

* cited by examiner

APPARATUS AND METHOD FOR ISOLATING BAST BARK AND WOOD BODY FROM A BAST PLANT STEM

This application is a National Stage Application of PCT/EP2014/002237, filed 14 Aug. 2014, which claims benefit of 102013013657.1, filed 15 Aug. 2013 in Europe, which applications are incorporated herein by reference. To the extent appropriate, a claim of priority is made to the above disclosed applications.

BACKGROUND OF THE INVENTION

The invention concerns a method for isolating bast bark and wood body from one or more bast plant stems, whereby the interior of the bast plant stem is composed of an essentially cylindrical wood body, which is covered radially by a bast bark containing bast fibers, and is connected to the bast bark by means of meristem tissue. Furthermore, the invention concerns a corresponding apparatus, a bast bark product, a bast fiber product, and a bast plant product.

TECHNICAL FIELD

Various processing methods of bast fiber plants are known from prior art. The bast fibers derived from bast plants, for example, flax, hemp, kenaf, oil flax, or jute, generate raw materials for very different uses. Such bast plants can yield textile raw materials, materials and intermediate products. For industrial raw materials, a difference is made between fiber-based raw materials and shive-based raw materials. The application or use of the raw material is based on properties that can be found either in the fibers or in the shives. The shives originate in the wooden pith of the bast plant stem, and are usually formed when the stem pith is crushed. Shives and fibers are subsequently separated in different known processes.

The treatment chain of bast plants begins with removing them from their location and continues via further field operations until bundling or concentration of the harvested bast plants. In this first phase, it is and was feasible to perform necessary operations manually.

After transportation and possibly one or more intermediate storage locations, stationary treatment usually takes place, which is performed by means of mechanical and hydrothermal methods. This method is dealt with in more detail below.

Further stationary treatment can be by means of chemical, bacterial, or enzymatic method steps. Here, the fibers are conditioned further for subsequent use, and separated from the other constituent parts of the fiber bast bark. Stationary finishing can subsequently take place, which can include washing, rinsing, and drying of the isolated bast fibers.

Previously, bast fibers were used for yarn production, for example, which is mainly of relevance to the clothing industry. Bast fibers are also used for fiber composites, whereby common artificial fibers can be replaced. Essential treatment methods for manufacturing press-molded parts are based on nonwoven fabrics. In this way, bast fibers are being increasingly used in further industrial areas of application, for example, aircraft manufacture and in the construction materials industry.

The quality of the resulting fibers and shives is impaired which has been problematic for previous bast fiber plant pulping methods. In this way, the methods that are used restrict considerably the scope of usage for fibers and shives in challenging applications. Different methods for fiber derivation depending on their length or on their degree of dryness are known.

For example, DE 199 18 166 A1 refers to a apparatus for producing short fibers that are derived from dry, pre-crushed, bast fiber plants. DE 195 18 188 A1 limits itself at the same time to the derivation of short fibers. Short fibers of this type are not suitable for manufacturing fine yarn efficiently, for example. It is possible instead to use them in products such as nonwovens, molded parts or similar. Furthermore, the already known mechanical methods for treating the bast fiber plants are restricted because the material must be dried or alternatively conditioned in some other way before processing.

Using the bast fiber products derived from the bast fibers is further restricted by the type of mechanical treatment. The widely-used impact separation methods in particular lead to permanent damage of the bast fibers, where shortening often accompanies pressure damage vertical to the fiber orientation. This usually happens through edges or cutting elements of rollers or rolling mills which cause damage to plant cells of the fibrils contained in the bast fibers.

This leads to the permanent loss of advantageous properties like high tensile strength, for example. These types of impact methods are known from DE 196 26 557 A1, EP 1 155 172 B1 and WO 2012/006118 A2. A usual characteristic of this impact separation method is that the stems of the bast fiber plants are transported to the machine, while simultaneously, methods including crushing, defibration, and separation of fibers from non-fibrous constituents are carried out.

The above-mentioned impact methods in particular result in a relatively high proportion of wooden constituents. In the subsequent method steps, it is almost impossible to eliminate all the shives from the material flow. Various prior art methods are dedicated to solving this problem, whereby DE 101 62 361 A1 in particular reports achieving a dust and shive content of at best 3%. Another disadvantage of the impact method is that fat residues and external bodies can penetrate the material flow. This problem is also cited in the above-mentioned publication, as well as in DE 100 07 509 A1.

Flax stripping is known from the article "Flachs and Hanf" (Flax and Hemp) by Gustav Schaefer, Ciba-Rundschau. Basel, 1944, p. 2262-2294. In the article, the painstaking manual peeling of hemp stems is described.

SUMMARY OF THE INVENTION

The object of the invention is to produce high-grade plant fibers that can be used in many application areas, whereby the above-mentioned disadvantages are eliminated or at least reduced for the most part.

This problem is solved by a method to isolate bast bark and wood body from a bast plant stem.

The invention is based on the knowledge that the previously used impact processes damage the plant's raw material is such a way that the fiber quality that is often required can no longer be guaranteed.

Furthermore, the invention is based on the knowledge that the growth layer (cambium), which connects the fiber bast bark with the wood body (pith), can be used advantageously to support the isolation method.

According to the invention, the method for isolating bast bark and wood body from a bast plant stem can also be used on a variety of bast plant stems. In this method, the interior of the bast plant stem(s) is/are formed from an essentially cylindrical wood body. This wood body is also called xylem and can possibly surround a hollow space that is also called ray parenchyma. The wood body is radially surrounded by the cambium, whereby the cambium forms the invention-related meristem tissue, and connects the wood body to the bast bark. In other words, the cambium separates the bast bark from the wood body. The bast bark has different constituent parts, e.g. the bast fibers that are gathered in bundles inside the bast bark. The bast plant stem may also have an outer skin (epidermis) which is arranged again around the fiber bundle or the bast bark. The function of the outer skin is usually to protect the bast plant from the outside. The cambium forms the growing part of the plant, which, radially inwards, is woody and radially outwards forms fiber bundles or bast fibers in the bast bark.

According to the invention, the bast bark is separated from the wood body, or at least from a constituent part of the wood body, in the area of the meristem tissue, using a tensile force along the bast fibers running in the bast bark, whereby a separating agent is applied between the bast bark and the wood body, or between the bast bark and a wood breaking body of the wood body.

Decisive is that the tensile force runs along the course of the bast fibers in the bast bark. This is advantageous because the bast fibers are especially resistant in this direction, and can bear strong loads or transfer forces, without being damaged themselves in the process. Choosing the direction of the tensile force determines a force distribution, which on the one hand can move the wood body, and on the other hand detaches the bast bark with the bast fibers from the wood body. Here, the meristem tissue, being the weakest layer, is strained until it tears open or is divided up into smaller parts, whereby residues of the meristem tissue can remain adhering to the wood body and the bast bark. The tensile force direction can now be chosen in such a way that the preferred force distribution can be set by the angle selection, thus advantageously replacing one or more means of transportation. It is also important in this method that no pressure or impact forces are exerted vertically to the bast fibers that could damage the bast fiber cells. It is of advantage that bast barks containing impact-free high-grade fibers with reproducible quality properties are derived in this way. In addition, stem pith in the form of the intact wood body can be provided.

It is of advantage that the method is suitable for freshly-harvested, dried, roasted, or re-moistened bast plant stems. In particular, dried or re-moistened bast plant stems can be used in the method, which previously were hardly processed, or not processed at all. Acknowledging the invention, only the strength of the tensile force has to be determined in order to transcend the bond of different firmness between the bast bark and the bast plant stem. The mechanical properties of the individual bast plant stems can be characterized using different parameter values, e.g., bending strength of the wood body, adhesion and peel strength between bast bark and wood body, tensile force of the bast bark, splitting strength of wood body and bast bark, as well as their elasticity modulus. The parameters mentioned can be summarized into a mechanical insulation resistance index, with which it is possible to make statements on whether the method according to the invention can be carried out.

Dry processing has only been made possible by the invention. This means that it is now possible to isolate the bast bark from the dried or stored plant stem. Previously the bast plant had to be isolated when freshly harvested, which always led to considerable effort, especially as all the bast plant bundles had to be processed as quickly as possible on location (in the field). As dry processing is now possible, the mechanical workload is substantially reduced, because a machine with dried plant stems can be utilized better in terms of time, and therefore fewer machines are required.

In order to ensure, according to the invention, an independent process-initiated peeling off of the bast bark from the wood body immediately after buckling at at least one of the stem sections created from buckling, it is required that the wood body in this area of the plant stem has sufficient bending stiffness to guarantee the peeling off of the bast bark on such a length of the wood body (depending on the respective adhesive strength between the bast bark and the wood body) that a surface stretches out sufficiently to enable subsequent application of a separating agent in the area between bast bark and wood body in order to continue the peeling process. The bending stiffness of the wood body results from the quotient of breaking load and the resistance moment determined by the form, as well as the cross sectional area, of the wood body in the affected section of the bast plant stem.

Furthermore, using this method along with the mechanical insulation resistance index parameters and while considering further framework conditions, it is possible to determine the necessary breaking load as well as the tensile force which brings about the separation of the bast bark from the wood body whereby the meristem tissue is separated.

Of advantage is the fact that the tensile force is applied to the bast bark in such a way that the bast bark opens an angle to the movement direction, or the longitudinal axis of the hollow body, or to the longitudinal axis of a constitute part of the hollow body from which the bast bark is separated. It is conceivable that the wood body will be crushed further during the method according to the invention, whereby the bast bark is only separated, according to invention, after crushing. Multiple divisions of the wood body are to be avoided, as otherwise similar problems that are already known from prior art could occur. Stem parts separated longitudinally may however support the usage of the method. Therefore stem parts can also be treated with the process according to the invention.

The angle to the movement direction or to the longitudinal axis of the wood body is chosen, for example, as vertically as possible to the longitudinal axis of the wood body or to the longitudinal axis of one of the constituent parts of the wood body, so that the main portion of the tensile force can be used for the separation of the bast bark from the wood body. The smaller the angle chosen, the greater the stem tensile force component applied to the stem part or its constituent parts, so that this can be used for movement.

If the method is carried out advantageously, this can include the following steps:

a. Production of a first and second stem part dividing the bast plant stem along its longitudinal axis, whereby the first stem part has a first cut wood body, and the second stem part has a second cut wood body, and b. A bending, at least of the first stem part, whereby the bast bark of the first stem part is arranged at a compressed point, and the bending force is increased until the first cut wood body on one of the stretched points of the stem part lying opposite the compressed point, breaks away outwardly from the bast bark in such a way that, from the first cut wood body, a first wood breaking body, and a second wood breaking body are formed, and c. The separation of the bast bark from the first wood breaking body.

This method of carrying out the isolation process can be simplified into the term “buckling isolation”. Both the longitudinal axis of the wood body and the longitudinal axis of a constituent part of the wood body are oriented to the essentially cylindrical form of the wood body that has a longitudinal axis which is also in agreement with the direction of plant growth.

The term stem division refers to its longitudinal division into at least two constituent parts and can be thus differentiated from the division of the meristem tissue. The first stem part and the second step part can be stem parts divided in half that have come about from a division along the longitudinal axis. However, this is not absolutely necessary if the stem is divided on a level in which the central longitudinal axis of the wood body is not arranged, but rather runs parallel to said level. The wood body of the stem part must always be cut through during stem division. At the same time, all additionally available layers are separated, for example, the meristem tissue and the bast bark.

Bending can be carried out both with the first, the second, or with both stem parts. Due to the radial stretching of the first stem part at the bending point, a compressed point comes about and one of the stretched points lying opposite the compressed point. The first stem part is now oriented in such a way that the bast bark is arranged at the compressed point, and the exposed wood body at the stretched point of the stem part. Bending is continued, and/or the bending force increased, until the first cut wood body of the first stem part breaks open outwardly in such a way that from the first cut wood body, a first wood breaking body, and a second wood breaking body are formed. It is process-relevant that the bast bark remains undamaged during bending and breakage, because the load on the compressed point is also primarily borne by the first cut wood body. The first cut wood body, in contrast, breaks open, whereby this breakage can be complete or only partial. With a complete break, the wood breaking bodies are completely separated from one another, whereby with a partial break, parts of the wood body still form connections between the first wood breaking body and the second wood breaking body. It is essential that the bast bark is sufficiently exposed, and thus separated from the first wood breaking body and ideally from the second wood breaking body as well. It is of advantage here that the separation and the bending happen more or less in one work step, and the bending agent can also be used to separate the bast bark.

It is of advantage that the bending of the first stem part and perhaps the second stem part is a three-point or a four-point bend. The respective bending is based on how many bending points are required for the respective bending and the subsequent break.

It is of advantage that the first cut wood body of the first stem part touches at least two outer bending points, and the bast bark of the first stem part touches at least one inner bending point, in particular two inner bending points. Both with the three-point bend, and the four-point bend, relative movement takes place, whereby it is sufficient that an outer or an inner bending point is moved opposite at least one other bending point, which can be an inner or an outer bending point. Relative here means that the position and the movement of the bending points in relation to one another is relevant, not however in relation to an isolation apparatus or an isolation machine. It is also conceivable that a bending point, a selection of bending points, or even all bending points move in relation to the above-mentioned apparatus.

At least one of the inner and outer bending points can be realized by a bolt, a bar, or similar. It is thus also conceivable that only one edge of a device part is sufficient to function as a bending point in contact with the first and/or second cut wood body. It should be noted that a bending point in reality is always realized by a contact area, whereby the size of the area depends on the bending force, meaning how hard the cut wood body to be bent is pressed on the bolt, the bar, or similar.

With an advantageous design, at least one inner bending point or at least one outer bending point performs a relative movement to another inner or outer bending point. In this way it is possible to cause an invention-related break of the wood body with a single movement of an outer or an inner bending point, whereby the respective single inner or single outer bending point becomes a breakpoint. This means that the breaking area is located near this single inner or outer movable bending point. It is of advantage when at least one inner bending point or at least one outer bending point can perform a relative movement to another inner or outer bending point.

Of advantage is the fact that the breakpoint of the bend of the first stem part is movable. In this way, the bast bark together with the wood breaking bodies can be transported further, and the method is ideally combined with the separation of the wood breaking bodies from the bast bark.

Instead of moving the breakpoint together with the bast bark to a separating agent, a separating agent emanating from the breaking area between bast bark and the first wood breaking body can alternatively be moved along the first wood breaking body, in order to separate the bast bark from the first wood breaking body. In this way, removing the bast bark from the wood breaking body is simplified to the effect that the separating agent of the meristem tissue can separate in the longitudinal direction in order to relieve the traction mean. In this way, it is possible that the bast bark is cleanly separated from the first cut wood body. For example, the tensile force can be transferred by the movement of the bast bark at the breakpoint, so that a relative movement to the separating agent ensures the bast bark is peeled off cleanly by the physical presence of the separating agent at the breaking open meristem tissue. In this way, the separating agent can also be a fixed element.

Alternatively to the buckling isolation, the bast plant stem can be cut at a first end in the longitudinal axis direction in such a way before applying the tensile force that the bast plant stem is divided into at least two hollow cylinder segments at the end. This procedure can be described as splicing at the end, whereby the introduction of a blade or other cutting element, pushes the wood body apart in such a way that the wood body breaks in the end area. Subsequently, by means of an additional element, a shifting force can be introduced into the meristem tissue, so that the bast bark removes itself from the longitudinal axis of the wood body in the radial direction if this did not already happen with the cut at the end. Now it is possible with a tensile element, for example a roller or pair of rolling mills, to grip the ends of the bast bark isolated in this way, and to pull the bast bark from the wood body of the remaining bast plant stem.

Several cutting processes or alternative cutting elements are conceivable for splicing at the end, for example, with a number of blades, or rotating disc cutters that can be driven into the bast plant stem from the front or side simultaneously. It is of advantage that through the application of the tensile force, a part of the bast bark, beginning at one of the hollow cylinder segments is separated from the wood body, whereby the number of hollow cylinder segments that are produced depends on the number of division processes or the number of cutting elements.

Adapting the tensile force and other parameters is required for bast plant stems in different stages, for example, for bast plant stems that are freshly harvested, dried, roasted or remoistened. A corresponding tensile force will always need to be determined, which will enable the method according to the invention to be carried out.

With an advantageous design, the apparatus used for isolating bast bark and wood body from bast plant stems that uses a method according to the invention is a stationary or mobile machine. Such machines are able to process single or multiple bast plant stems in the form of bundles or balls, according to the invention. Additional components are used, which for example realize the harvest, the transportation, the arrangement or the conditioning of the bast plant stems.

With an advantageous design of the apparatus for the isolation of the bast bark and wood body from bast plant stems, this apparatus has the following components:

a. Means of division (dividing agent) and production of a first and second stem part to cut through the wood body along the longitudinal axis of the bast plant stem, so that the first stem part has a first cut wood body and the second stem part has a second cut wood body, b. Means of bending (bending agent), at least of the first stem part, whereby the bast bark of the first stem part is arranged at a compressed point, and the bending force is increased until the first cut wood body on one of the stretched points of the stem part lying opposite the compressed point, breaks open outwardly from the bast bark in such a way that, from the first cut wood body, a first wood breaking body, and a second wood breaking body are formed, c. Means of separation (separating agent) of the bast bark from the first and/or second wood breaking body.

Of advantage is a first dividing agent, a plant stem transport element, in particular a pair of rollers/rolling mills, and a second dividing agent, a plant stem blade, for cutting through the bast plant stem along the longitudinal axis of the bast plant stem. The positioning of the blade in relation to the plant stem transport elements is decisive when it is important that the bast plant stem is separated as centrally as possible, or when a multiple division is desired.

It is of advantage that after a break of the first cut wood body, a first bending agent is provided to bring the two wood body particles produced by the break into motion by affecting the bast bark. In this way, it is possible to initiate with the movement of the first bending agent the break of the first cut wood body, and to enable the separation, which can also be realized through a relative movement of the first bending agent at a fixed angle to the stem axis.

It is of advantage that the apparatus is intended to simultaneously process a number of bast plant stems or stem parts. This can affect the most varying work steps, for example, bending, breaking, or separation of the bast bark from the wood body, or from the cut wood body.

With an advantageous design, the apparatus is intended to align a number of stem parts parallel to one another before the bending process, so that their cutting surfaces are oriented in the same direction, and a first bending agent is provided to bend these multiple stem parts simultaneously, thus breaking them specifically. A first separating agent could be a pair of rollers/rolling mills for example. A pair of rollers/rolling mills is primarily a transport mean; however, this transport causes a separation of the bast bark from the wood body, which turns the pair of rollers/rolling mills into a separating agent. Bolts, bars, or edges can also be used as separating agent, in that they are inserted between the bast bark and the wood body, or a cut wood body.

Products can be produced from the bast bark (and the derived bast fibers and their specific components) and the wood body using the invention-related method. These products are subsequently called bast bark products and bast fiber products.

The initial raw material, bast bark, isolated by the method according to the invention has hardly been damaged in its cell material, and is also of considerable length. In this way, the bast fibers and the bast bark itself are essentially suitable for all applications in which typically plastic fibers are also used. Through a corresponding process for shortening, the bast bark can be used in the same way as short fibers previously were. The bast bark according to the invention has significantly better material properties, and leads to more high-quality products, in particular area- or line-shaped textile forms from naturally ending or, via corresponding processes, continuously assembled bast bark.

It is of advantage that the bast bark derived according to the invention, or the derived bast fibers have a wood portion of less than 1%, and are thus essentially free of shrives. As result, the bast fiber product and the bast bark product are also free of shrives.

With an advantageous design, a number of bast bark strips are arranged towards one another in a roving. This roving can, for example, be formed as a mat and create an especially high-tensile material, that can be used in particular in the automotive industry to strengthen flat components.

It is of advantage that the bast bark strips of the roving are woven or sewn together. In the case of interweaving, the manageability of the roving when integrating into a matrix or when molding is clearly more advantageous. In addition, the roving is less sensitive to a displacement of bast barks arranged towards one another. Two or more layers of bast bark can be sewn together, whereby structural stability is also generated. This Malimo technique is already used as a textile production method.

The roving can also be formed with bast barks that are arranged unidirectionally or multi-directionally. Both have an influence on evenness and stability. In addition, rovings can be formed three-dimensionally or two-dimensionally. The roving can, especially in combination with a matrix, already create the final form of the component to be produced, e.g. a vehicle door, and be fixed by means of the matrix.

With an advantageous design, the roving is embedded as a reinforcement in a matrix. By matrix is meant a hardened material that rigidly absorbs the bast bark or the bast fibers, and that binds the bast bark or the bast fibers through adhesive and cohesive forces. A matrix is typically poured and fixes the bast bark or bast fibers into their position to one another. By using fiber materials, fiber plastic composites normally have an elasticity behavior that is dependent on direction. A composite material is formed with the matrix that can be further processed as an interim product. The bast bark or the bast fibers can also be subjected to pre-treatment that supports a better connection to the matrix. Pre-treatment can consist in part or completely of a cleaning of the bast bark strips.

It is of advantage if the matrix is a plastic matrix, a resin matrix, a vegetable oil-based matrix, or a matrix based on a petrochemical raw material. Thermosetting plastics on a vegetable oil basis create an advantageous matrix, which although requiring a connection to the bast bark, are biogenic and stable at the same time. Alternatively, proven thermoplastics or resins can be used as a matrix.

It is of advantage if natural matrix materials (also known as mastics), e.g. pectin or lignin, are used to produce a natural matrix, so that the bast bark product is completely, or for the most part, biogenic. Especially with such a natural matrix it makes sense to clean the bast bark strips as a pre-treatment in order to ensure an optimal connection of the bast bark strips to the natural matrix. The strength of known plastic fiber-based composite materials is greatly exceeded by the composite material on a bast bark basis. The composite material on a bast bark basis is only one example of a bast bark product.

It is of advantage that residues of the meristem tissue still adhere to the bast fibers. This represents a production benefit. In individual cases and depending on the use, it is absolutely tolerable that the meristem tissue still partly adheres to the bast bark. From the meristem tissue, which dries out after separation, it is recognizable that a bast bark is involved that has been isolated by the method according to the invention.

In some cases, the bast bark continues to be treated after separation and, in particular, is opened mechanically, chemically, biologically, or hydrothermically. It is of advantage that the bast fiber product can be a bast fiber composite material, a bast fiber roving or a bast fiber yarn. With the bast fiber yarn, diverse process steps are required after isolation of the bast bark in order to produce the bast fiber yarn.

A further valuable product is the bast plant product, which is derived by using the method according to the invention, and is produced by the wood bodies. The wood bodies of the bast plant consist of an extremely stable and light lignified tissue, which can be processed and used similarly to balsa wood.

Other advantageous forms and preferred advanced forms of the invention can be found in the figure descriptions and/or the subclaims.

The invention is described and explained in more detail below on the basis of the embodiments presented in the figures.

BRIEF DESCRIPTION OF THE DRAWINGS

Shown are.

DETAILED DESCRIPTION OF THE PREFERRED EMBODIMENTS

Figure 1A:
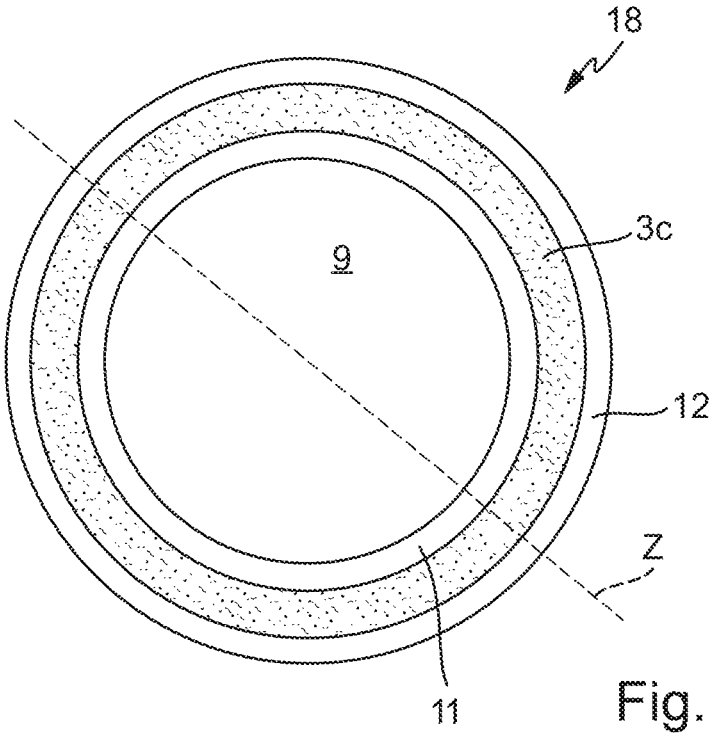
FIG. 1*a* Cross section of a bast plant stem.

FIG. 1*a* shows a cross-section of a bast plant stem, whereby the cutting surface Z essentially runs centrally through the wood body 9. The wood body 9 is connected with the bast bark 3*c* via the meristem tissue 11. It could also be said that, because of the arrangement, the wood body 9 is separated from the bast bark 3*c* via the meristem tissue 11. The bast plant stem 18 is protected externally by the outer skin 12 that is arranged around the bast bark 3*c*.

Figure 1B:
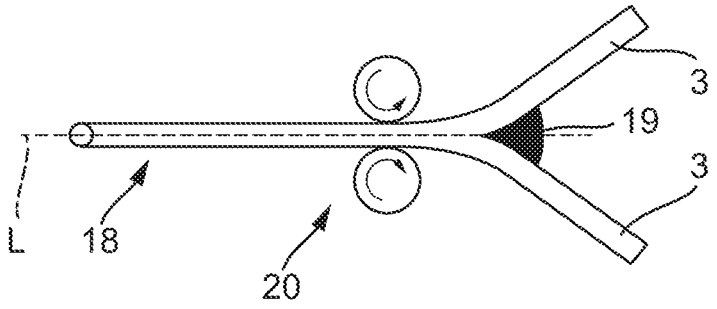
FIG. 1*b* Separation of a bast plant stem.

FIG. 1*b* shows a bast plant stem 18 that is transported via the pair of rolling mills 20 along the longitudinal axis L in order to be divided essentially centrally into two stem parts 3 at the plant stem blade 19. The central division is not absolutely necessary, but is advantageous for the method, because both stem parts 3 can be treated in the same way.

In the subsequent FIGS. 2 to 14, no reference is made to the outer skin 12. Instead, for reasons of simplification, only the bast bark 3*c* is referred to.

Figure 2:
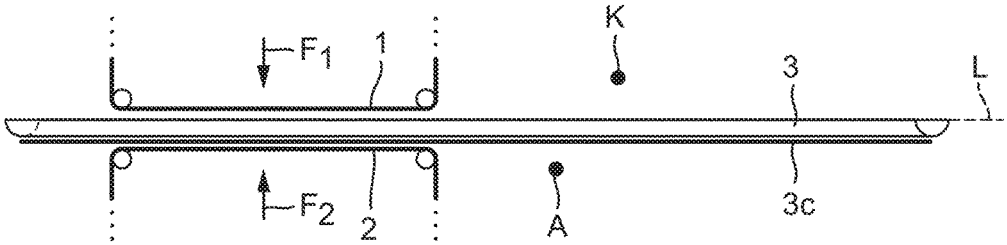
FIG. 2 First work step of buckling isolation.

FIG. 2 shows one of the stem parts 3 from FIG. 1*b*, which by using a top transport mean 1 and a bottom transport mean 2 fixates the stem part 3 with holding strength F1 or holding strength F2, while simultaneously moving along the longitudinal axis of the stem part, so that the stem part 3 can be arranged between bending points A and K. A represents an inner bending point and K an outer bending point during this.

Figure 3:
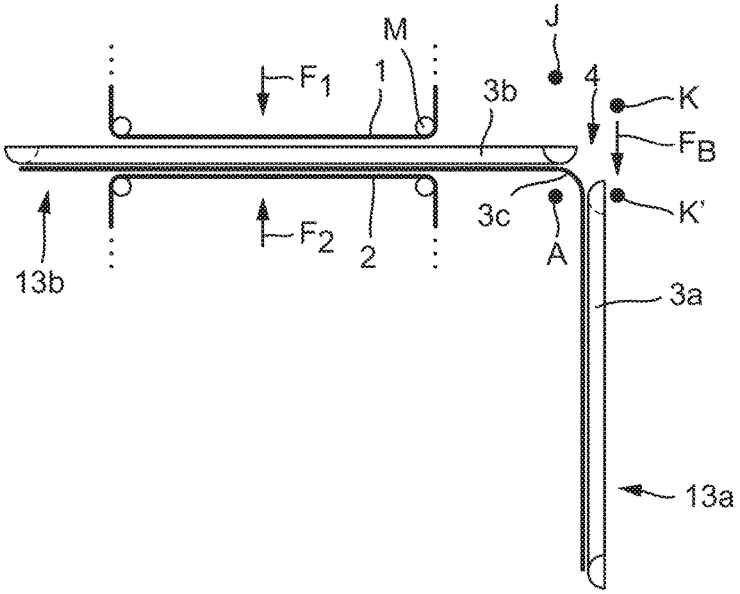
FIG. 3 Second work step of buckling isolation in order to bend and break the stem part, FIG. 4 Third work step for initiating isolation, FIG. 5 Fourth work step of buckling isolation, FIG. 6 Start of a fifth work step of buckling isolation, FIG. 7 A representation of the fifth work step in FIG. 6, FIG. 8 First work step of the second embodiment of the method at start of buckling, FIG. 9 Second work step of the second embodiment, FIG. 10 Third work step of the second embodiment, FIG. 11 Fourth work step of the second embodiment for the transition from buckling to isolation, FIG. 12 Fifth work step of the second embodiment, FIG. 13 Three-dimensional view of a stem division at the end, a third embodiment of the method, and FIG. 14 A separation of the bast bark according to the third embodiment in FIG. 13.

FIG. 3 shows bending and break of stem part 3, whereby the movable outer bending point K is vertical to the longitudinal axis L, in order to cause an open breakage area 4 at the bend and breakpoint A. After the break is completed, the outer bending point K has moved to position K'. Involved here is a three-point bend, or a three-point break, whereby the top transport mean 1 functions as the outer bending point. In this way, the outer bending point K has moved relative to bending points A and M, whereby A and M could be static bending points. Alternatively, it is conceivable that two or even all three bending points A, K, and M will move.

The undamaged bast bark 3*c* which contains the bast fibers is touching breakpoint A. The following FIGS. 4, 5, 6 and 7 show the separation of both stem parts 3*a* and 3*b* from the undamaged bast bark 3*c*.

Figure 4:
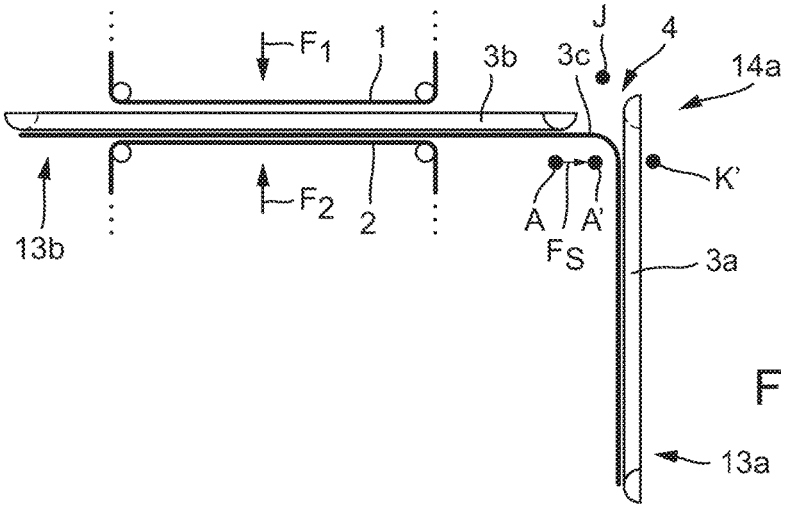
Figure 5:
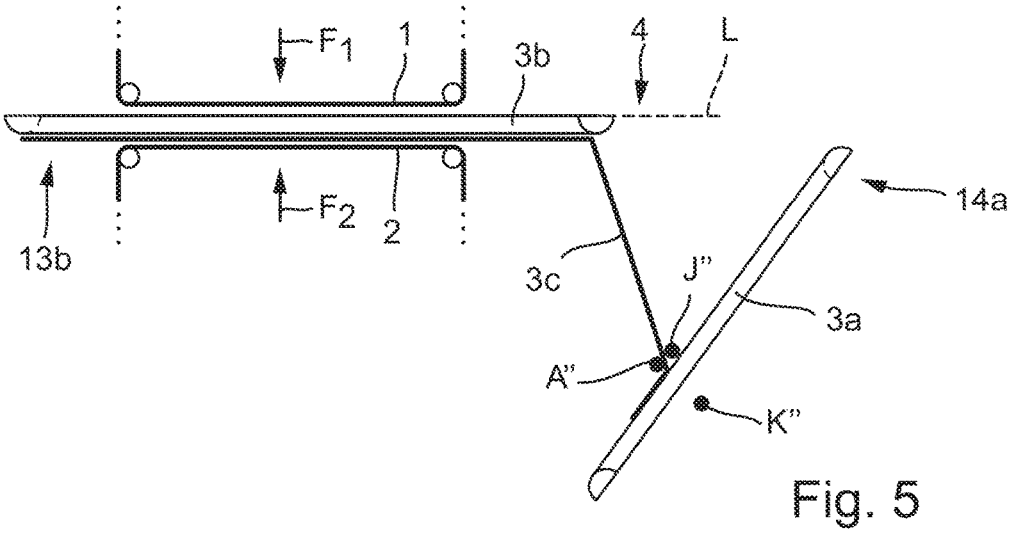

FIGS. 4 and 5: The separation of the first wood breaking body 3*a* is only ensured because the previously fixed bending point A is transported due to the force Fs in the longitudinal direction of the second wood breaking body, and, simultaneously, moved essentially vertically to the first wood breaking body. In this way, bast bark 3*c* separates in breakage area 4 at end 14*a* so far that the separating agent J can be applied between bast bark 3*c* and the first wood breaking body. Now the separating agent J and the bending points A and K can be moved essential vertically to the longitudinal direction of the second wood breaking body, so that the bast bark 3*c* is peeled and the first wood breaking body 3*a* is removed from breaking point 4. This can be continued until the complete separation of the first wood breaking body 3*a* from the bast bark 3*c*.

Figure 6:
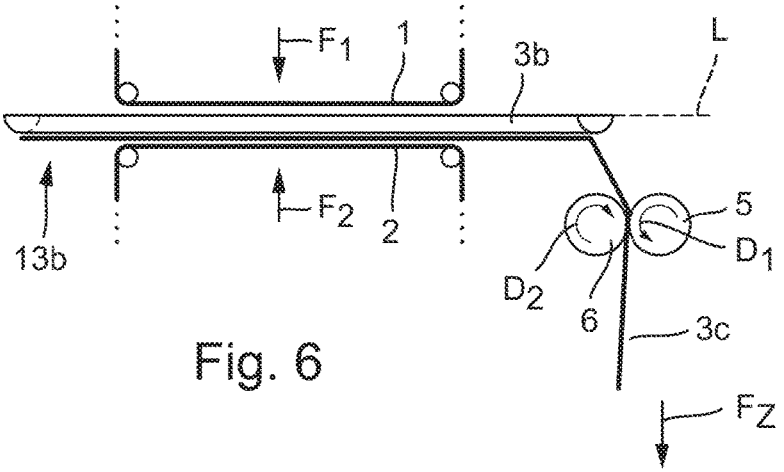
Figure 7:
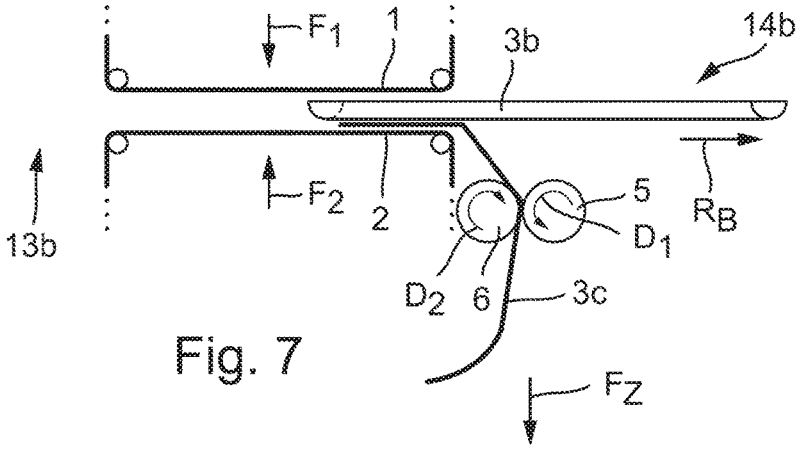
Figure 8:
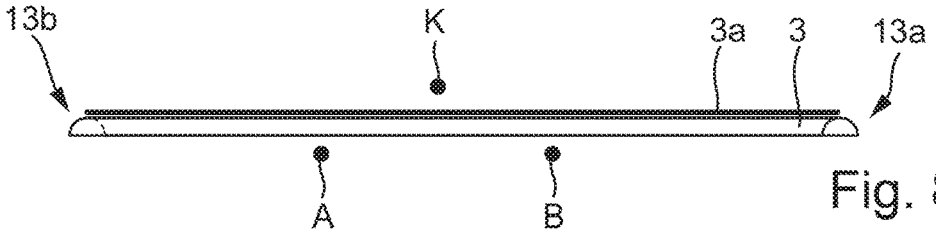
Figure 9:
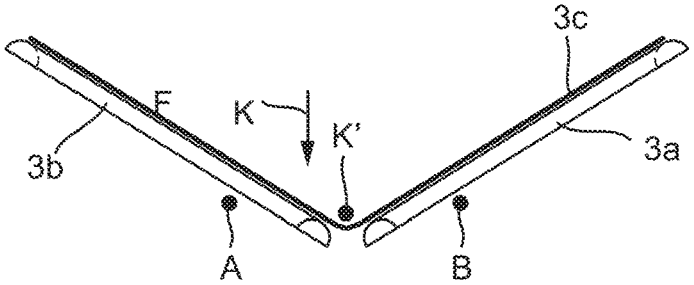
Figure 10:
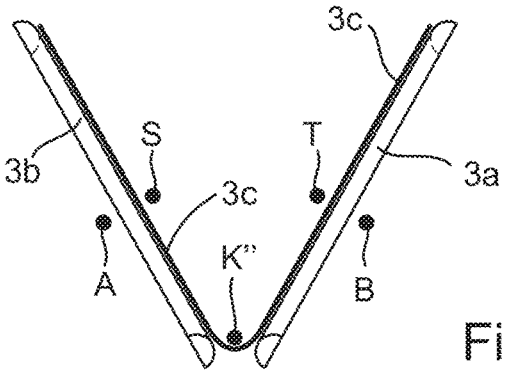
Figure 11:
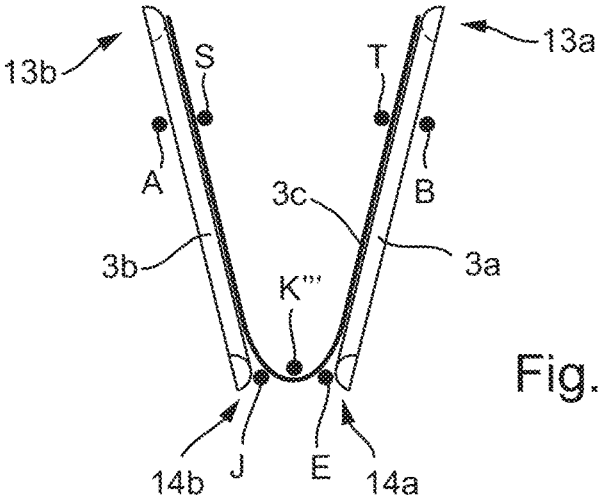

FIGS. 6 and 7 show the subsequent separation of bast bark 3*c* from the second wood breaking body 3*b*, in which a pair of rollers 5, 6 is used to move the fiber bast bark 3*c* vertically to the longitudinal direction of the second wood breaking body via an opposing rotation of rollers 5 and 6. In this way, in combination with the transport means 1 and 2, movement of the second wood breaking body 3*b* in its longitudinal direction L is caused, so that the separation happens simultaneously.

FIG. 7 shows the separation of bast bark 3*c* from the second wood breaking body 3*b* in an advanced state.

FIGS. 8 to 12 show a second embodiment of the method according to the invention buckling isolation in a three-point bend. The inner bending point K moves relative to the outer bending points A and B. During this, the inner bending point K touches the bast bark 3*c* and the outer bending points A and B touch the cutting surface of the cut wood body. The outer bending points A and B do not move, whereby the inner bending point K runs between bending points A and B.

In a new position K' of bending point K, stem part 3 breaks in the wood breaking bodies 3*a* and 3*b* while applying bending force $F_K$. Afterwards, the bast bark 3*c* is driven onwards by the movement of the bending and breakpoint K, together with the two wood breaking bodies 3*a* and 3*b*, whereby the two wood breaking bodies 3*a* and 3*b* are guided by the stopping points S and T in combination with the bending points A and B.

In a new position K'", the movement continues until the bast bark 3*c* is positioned between the separating agents J and E, and simultaneously separating agents J and E are brought into position between the bast bark 3*c* as well as the first and second wood breaking bodies 3*a* and 3*b*. In this way, the isolation of the bast bark 3*c* is realized directly by a simple continuation of the bending and break movement.

Figure 12:
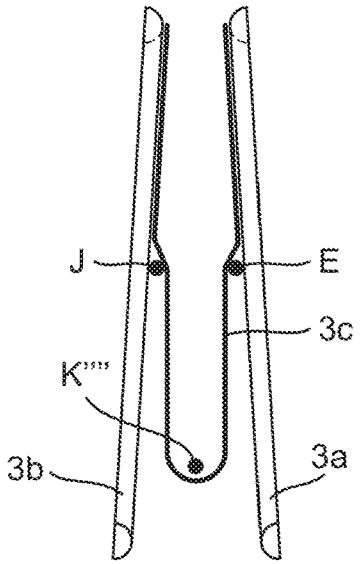

In FIG. 12, the separation movement is represented at an advanced stage. The break and bending point K"" is shifted so far that the bast bark 3*c* is almost evenly separated from the wood breaking bodies 3*a* and 3*b*. For complete separation, the movement of the bend and breakpoint K is continued.

The arrangements of the design of the buckling isolation in FIGS. 2 to 12 can be realized by, for example, long bars in the shown bending points A and B, separating agents E and J, and stopping points S and T, whereby several stem parts 3 can be bent and broken in multiples per realized bend, or break. The stem part 3 is solely to be realized as multiples that are arranged parallel to one another, whereby the cut surfaces or gap surfaces must be oriented to the same side.

Figure 13:
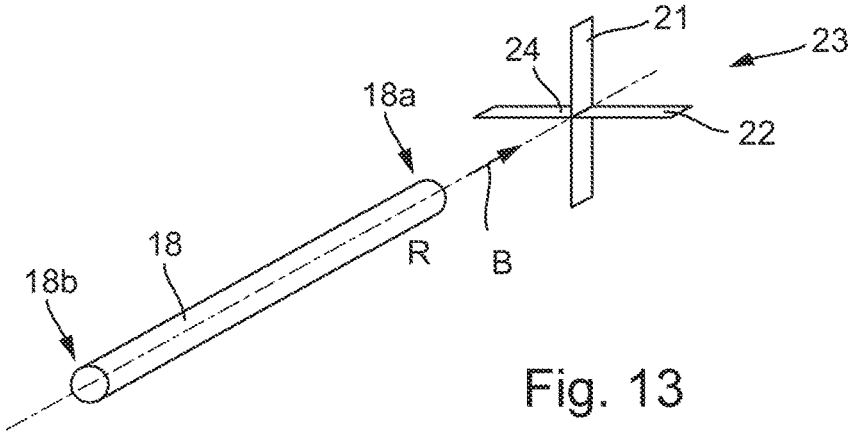

FIG. 13 shows an alternative design of the method according to the invention, in which the bast plant stem 18 moves in longitudinal direction and, for example, is cut by a cutting element 23 with the blades 21 and 22 in point 24, and can thus be spliced open. The wood body 9 and the bast bark 3*c* are separated at the end into four parts during this method.

Figure 14:
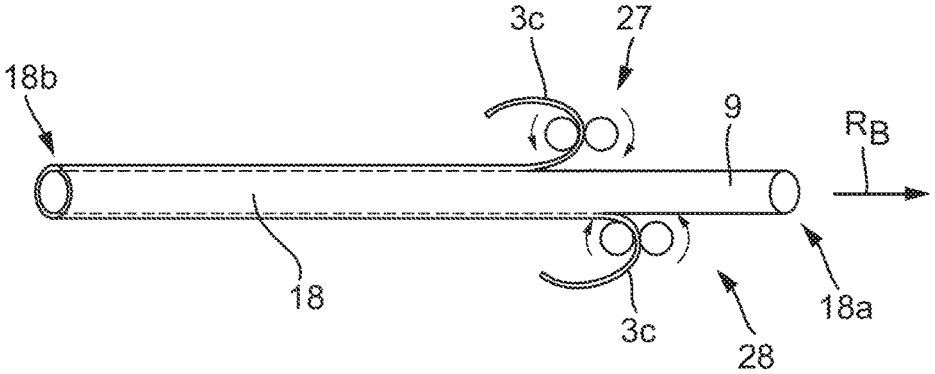

FIG. 14 shows the peeling off of the bast bark 3*c* from an undivided bast plant stem 18, in which the pair of rollers 27 and 28 are used. Because of the catching and removing of the bast bark 3*c*, a movement of the wood body 9 in the direction of Rb is caused completely automatically, whereby the peeled-off wood body 9 is also ejected.

In summary, the invention concerns an energy-efficient method, and a device for isolating bast bark 3*c* and wood body 9 from a bast plant stem 18, or from a number of bast plant stems 18, as well as isolated bast bark 3 and wood body 9. The resulting products have a higher quality than those from bast fibers or shives according to the prior art. It is suggested that the bast bark 3*c* is separated along the meristem tissue 11 using a tensile force Fz along the bast fibers of wood body 9 running in bast bark 3*c*, or at least of a constituent part 3*a* or 3*b* of wood body 9. In this way, synergies are created, both during the isolation and during the exploitation of the raw materials bast bark 3*c* and wood body 9. Besides these bast bark products, the associated bast fiber products also have advantageous properties.

DESIGNATION LIST

A Bending point
B Bending point
$D_1$ Direction of rotation
$D_2$ Opposing direction of rotation
E Separating agent
$F_1$ Holding strength
$F_2$ Holding strength
$F_B$ Bending force
$F_K$ Bending force
$F_S$ Force in longitudinal direction
$F_Z$ Tensile force
J Separating agent
K Breakpoint, bending point
L Longitudinal axis
M Bending point
$R_B$ Movement direction
S Stopping point
T Stopping point
Z Cutting surface
1 Transport belt, top
2 Transport belt, bottom
3 Stem part
3*a* First wood breaking body
3*b* Second wood breaking body
3*c* Bast bark
4 Breakage area
5 Roller
6 Roller
9 Wood body
11 Meristem tissue
12 Outer skin
13*a* End
13*b* End
14*a* End
14*b* End
18 Bast plant stem
18*a* First end
18*b* Second end
19 Stem blade
20 Pair of rolling mills
21,22 Blades
23 Cutting point
24 Point
27 Pair of rollers
28 Pair of rollers

The invention claimed is:

1. Method for isolating bast bark and wood body from a bast plant stem, wherein the interior of the bast plant stem is composed of an essentially cylindrical wood body, and the wood body is covered radially by a bast bark containing bast fibers, and is connected to the bast bark by meristem tissue, the method comprising the steps:

a. producing of a first and second stem part by dividing the bast plant stem along the longitudinal axis, wherein the first stem part has a first cut wood body, and the second stem part has a second cut wood body, b. bending at least of the first stem part, wherein the first stem part is arranged so that the compression is on the bast bark side and the bending force is increased until the first cut wood body on a stretched point of the stem part, the stretched point being opposite to the compressed point, breaks open outwardly from the bast bark in such a way that, from the first cut wood body, a first wood breaking body and a second wood breaking body are formed, and c. separating the bast bark from the first wood breaking body by peeling, wherein the bast bark is peeled from the first wood breaking body via the division of the meristem tissue using a tensile force, wherein a separating device is applied between the bast bark and the first wood breaking body of the wood body until the bast bark is completely peeled from the first wood breaking body.

2. Method according to claim 1, wherein the tensile force is exerted in such a way on the bast bark that the bast bark opens an angle to the movement direction, or to the longitudinal axis of the first wood breaking body, from which the bast bark is separated.

3. Method according to claim 1, wherein the bend of the first stem part is a three-point bend or a four-point bend.

4. Method according to claim 3, wherein the cut wood body of the first stem part touches at least two outer bending points and the bast bark of the first stem part touches two inner bending points.

5. Method according to the claim 3, wherein at least one inner bending point or at least one outer bending point achieves relative movement to one other inner or outer bending point.

6. Method according to claim 3, wherein at least one inner bending point is a breakpoint.

7. Method according to one of the claims 3, wherein the separating device starting from a breakage area between bast bark and the first wood breaking body is moved so that the bast bark is to be separated from the first wood breaking body, wherein the not yet separated stem part is restricted in movement.

8. Method according to one of the claims 1, wherein, before applying the tensile force to a first end, the bast plant stem is cut in such a way in the direction of the longitudinal axis that the bast plant stem is divided at the end into at least two hollow cylinder segments.

9. Method according to claim 8, wherein a part of the bast bark, beginning at an end of the hollow cylinder segment is separated from the wood body by applying the tensile force.

10. A method for isolating bast bark and wood body from a bast plant stem, wherein the interior of the bast plant stem is composed of an essentially cylindrical wood body, and the wood body is covered radially by a bast bark containing bast fibers, and is connected to the bast bark by meristem tissue, the method comprising the steps:

a. producing of a first and second stem part by dividing the bast plant stem along the longitudinal axis, wherein the first stem part has a first cut wood body, and the second stem part has a second cut wood body, b. bending at least of the first stem part, wherein the first stem part is arranged so that the compression is on the bast bark side and the bending force is increased until the first cut wood body on a stretched point of the stem part, the stretched point being opposite to the compressed point, breaks open outwardly from the bast bark in such a way that, from the first cut wood body, a first wood breaking body and a second wood breaking body are formed, and c. separating the bast bark from the first wood breaking body, wherein the bast bark is separated from the first wood breaking body via the division of the meristem tissue using a tensile force, wherein a separating device is inserted between the bast bark and the first wood breaking body of the wood body and peeling the bast bark from the first wood body by moving the separating device between the bast bark and the first wood body.

* * * * *